US007765722B2

(12) United States Patent
Berrins

(10) Patent No.: US 7,765,722 B2
(45) Date of Patent: Aug. 3, 2010

(54) SANDAL WITH ADJUSTABLE STRAPS AND INTERCHANGEABLE MIX AND MATCH STRAPS AND INSOLES

(76) Inventor: Marlene Berrins, 218-35 82 Ave., Hollis Hills, New York, NY (US) 11427

( * ) Notice: Subject to any disclaimer, the term of this patent is extended or adjusted under 35 U.S.C. 154(b) by 460 days.

(21) Appl. No.: 11/901,316

(22) Filed: Sep. 17, 2007

(65) Prior Publication Data

US 2008/0098622 A1 May 1, 2008

Related U.S. Application Data

(60) Provisional application No. 60/863,013, filed on Oct. 26, 2006, provisional application No. 60/923,948, filed on Apr. 16, 2007.

(51) Int. Cl.
*A43B 3/24* (2006.01)
*A43B 3/12* (2006.01)

(52) U.S. Cl. ..... 36/101; 36/100; 36/11.5; 36/15

(58) Field of Classification Search ..... 36/101, 36/100, 11.5, 15, 135
See application file for complete search history.

(56) References Cited

U.S. PATENT DOCUMENTS 2,651,117 A * 9/1953 Harris ..... 36/112
6,282,818 B1 * 9/2001 Lu ..... 36/110
6,418,643 B1 * 7/2002 Yang ..... 36/101
6,442,869 B2 * 9/2002 Coomes ..... 36/11.5
6,442,870 B1 * 9/2002 Tsai ..... 36/11.5
6,718,658 B2 * 4/2004 Karasawa ..... 36/97
7,162,814 B2 * 1/2007 Berg et al. ..... 36/11.5
7,210,251 B1 * 5/2007 Rolle ..... 36/100
7,578,076 B2 * 8/2009 Pawlus et al. ..... 36/100
2002/0174569 A1 * 11/2002 Tsai ..... 36/101
2005/0034332 A1 * 2/2005 Moschel et al. ..... 36/101

* cited by examiner

*Primary Examiner*—Ted Kavanaugh

(57) ABSTRACT

A sandal comprised of layered footwear components includes a lower base, a middle member replaceable platform which secures the straps, and an upper member replaceable insole. A hollowed out center area creates a perimeter side wall on the top of the base into which the platform is stored. A frontal (toe area) and rear (heel area) ledge crosses the toe and heel areas of the superior base horizontally. The straps are attached to a platform and secured by a present choice of a hook and loop fastener. The front and rear of the platform is eased under the front and rear ledges on the base. A midpoint lock on the platform further secures the platform to the base. A final top layer insole is secured on top of the platform and under the overlapped straps and placed into the remaining hollow area of the base hiding the shoes components. The straps and insole cooperate to form a shoe upper for receiving the foot. Platforms and insoles are interchangeable to heel, flat or wedge style bases. Exchangeably connected straps to platforms are repeatedly adjustable in horizontal and vertical directions for comfort and mix and match to create many shoe styles.

1 Claim, 11 Drawing Sheets

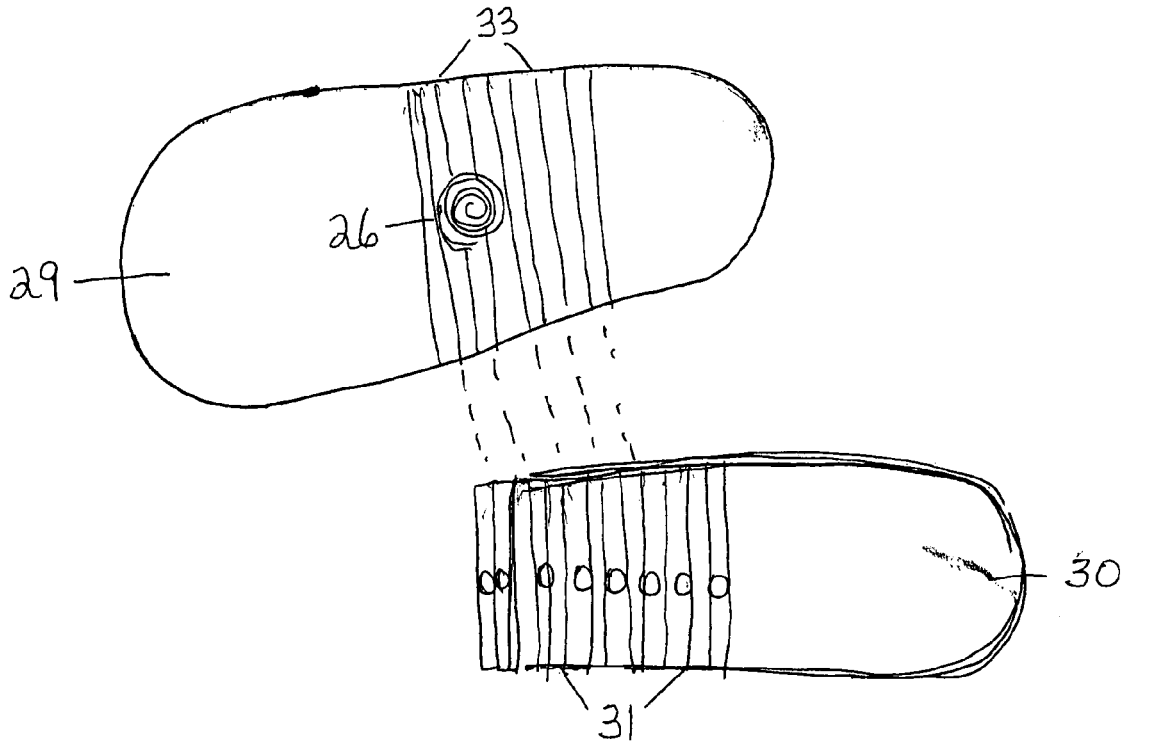
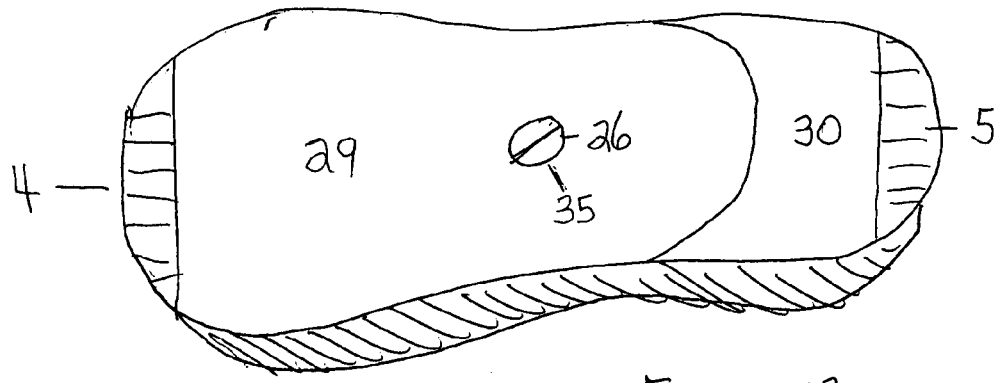
Figure 13

SANDAL WITH ADJUSTABLE STRAPS AND INTERCHANGEABLE MIX AND MATCH STRAPS AND INSOLES

REFERENCE TO RELATED APPLICATION

This application is based on provisional application No. 60/863,013 filed Oct. 26, 2006, and updated with provisional Pat. No. 60/923,948 filed on Apr. 16, 2007, the priority of which is claimed.

FIELD OF THE INVENTION

The present invention relates generally to footwear and, more specifically, to a sandal with adjustable and replaceable straps and replaceable insoles which are interchangeable to a variety of shoe bases to allow aesthetic and functional changes to the shoe.

BACKGROUND OF THE INVENTION

Footwear comes in a vast variety of styles and designs to suit numerous functional and aesthetic goals. People are all individuals with variances in body parts including their feet. Foot specifications vary in width, bone structure, toe lengths, protrusions, and varying positions of instep. Feet can swell from changes in weather, excessive walking, or increased salt intake. One foot may be wider then the other. All feet are different and individuals are often uncomfortable in over the counter footwear. The present invention enables the consumer to adjust the sandal straps up or down and adjust the width of the straps as well to increase their personal comfort. Custom molded shoes can be expensive and the present invention would offer this benefit for a moderate amount of money. The ability to alter width or strap location at any time would be a benefit to most individuals.

The present invention also offers the consumer the ability to mix and match straps and insoles to customize their shoe whenever required. An ankle strap can be removed and reapplied at any chosen time. All straps are removable and replaceable to any platform. The consumer can purchase a set of new straps with or without a new platform. Having each pair of straps mounted on its own platform makes it more convenient to simply slide and lock into the base, cover with insole and go. It will maintain the consumer's personal adjustments for next time. Any platform is transferable to any style (heel, flat, or wedge) sandal of the same size. All insoles are also transferable to any style of same size sandal. A soiled insole can be replaced when needed. All of the possible variations increase the consumer ability to affordably increase their amount of foot attire.

DESCRIPTION

Figure 1:
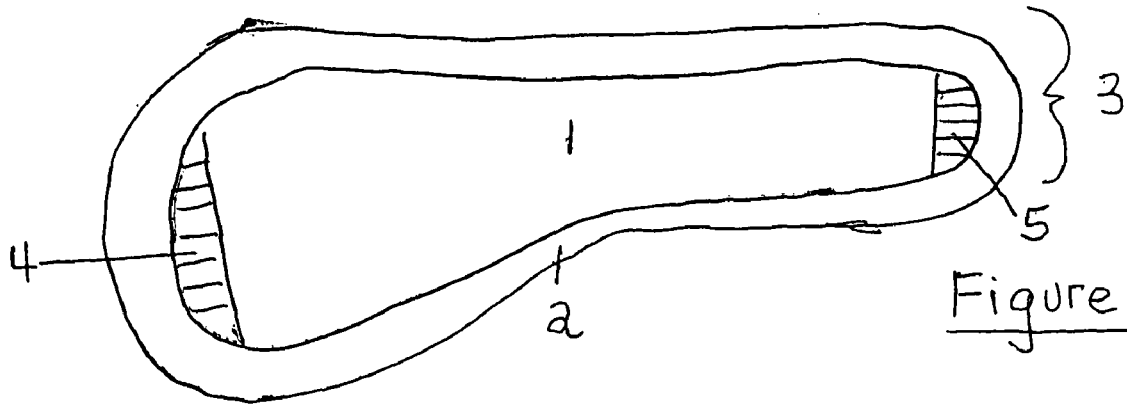
FIG. 1: is a top view of the lower base
Figure 2:
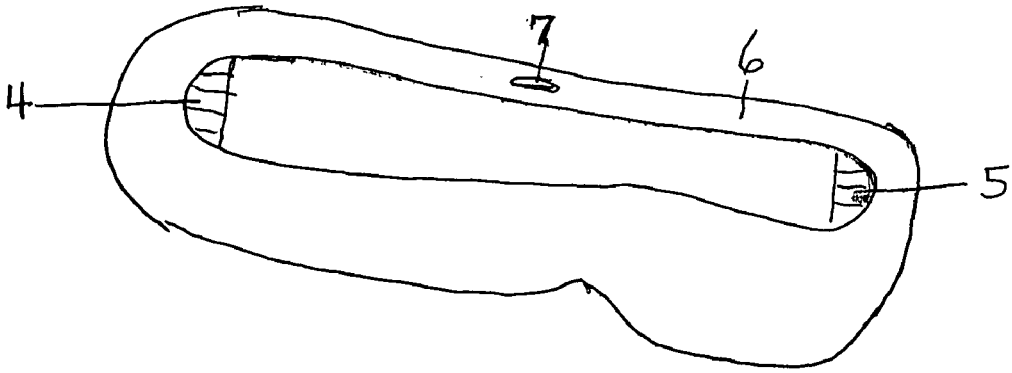
FIGS. 2-3: is a perspective view of the lower base
Figure 3:
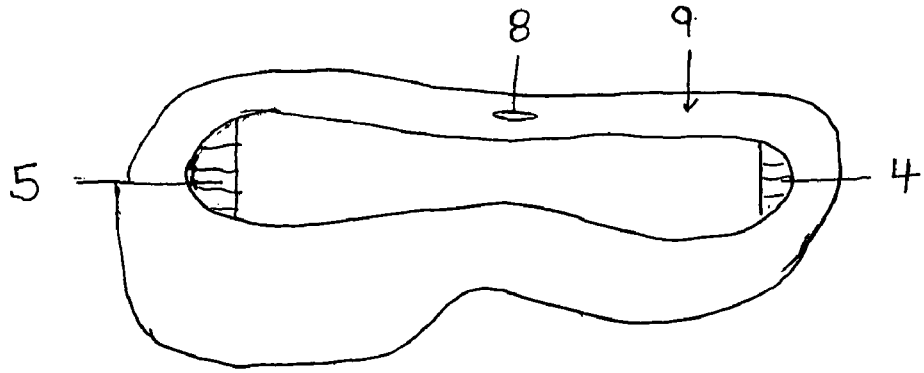
Figure 4:
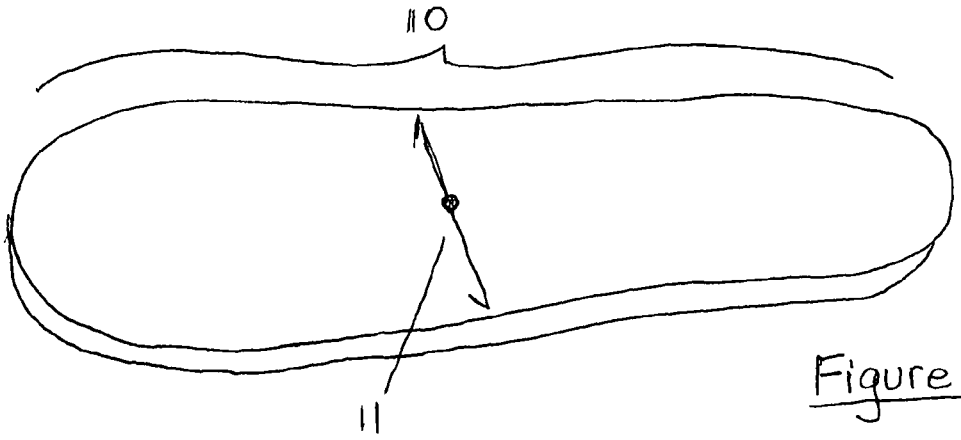
FIG. 4: is an embodiment of the platform

The present invention provides improved footwear that overcomes many of the limitations of the prior art. A sandal according to the present invention includes a lower base for contacting a support surface, a middle member platform for securing the straps and an upper surface for receiving a user's foot. The lower base has a hollowed out center area in it's top surface (FIG. 1 #1) which creates a perimeter side wall approx. ¼" wide by ⅜" high (FIG. 1 # 2) and the wall surrounds the entire top perimeter of the base. The base also contains a front (toe area) (FIG. 1 # 4) and also a rear (heel area) ledge (FIG. 1 #5) of approx. ¼ "to ½" wide which crosses the toes and heel areas horizontally and aids in securing the (middle layer) platform (FIG. 4 # 10), and the base also contains a left (FIG. 2 # 7) and right groove (FIG. 3 # 8) in the midpoint area of the base wall (at the midpoint of the shoes length) which creates a locking receiver for the platform lock (FIG. 4 # 11) and completes the security layer for the shoe straps. The semi flexible platform (FIG. 4 # 10) (cut or molded to the size and shape of the hollow area on the top base) when inserted into the hollow area of the base snugly contacts the perimeter side wall of the base in all directions and when slightly flexed at it's midpoint is easily eased under the front and rear ledges (FIG. 9) and a lock located on the midpoint superior platform turns manually and enters the side grooves of the mid perimeter wall of the base (FIG. 9 # 11) securing the platform into the base.

(Alternate lock FIGS. 12 # 26, 27 & 28) This alternate lock simply attaches the mid point of the platform with a screw that enters a hole in the mid platform and enters a center hole in the superior mid base having internal tread. The screw when rotated with a key (FIG. 12 # 28) enters the treads and secures the platform to the base.

Figure 5:
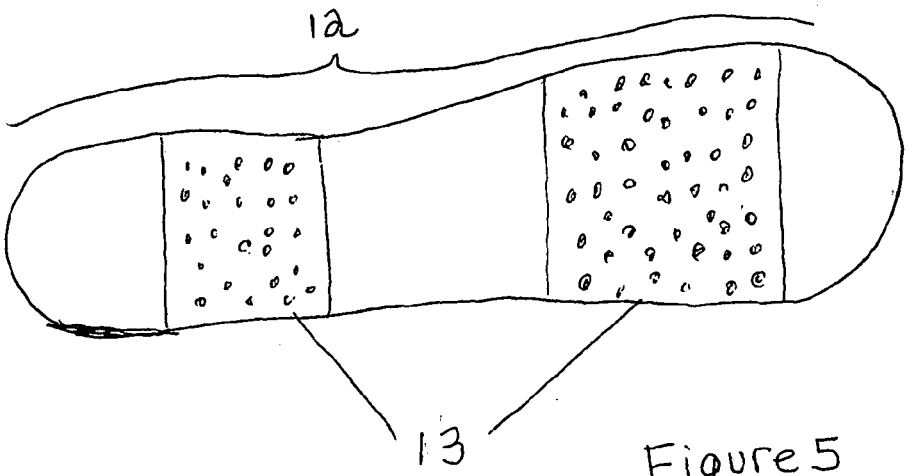
FIG. 5: is a bottom view of the platform
Figure 6:
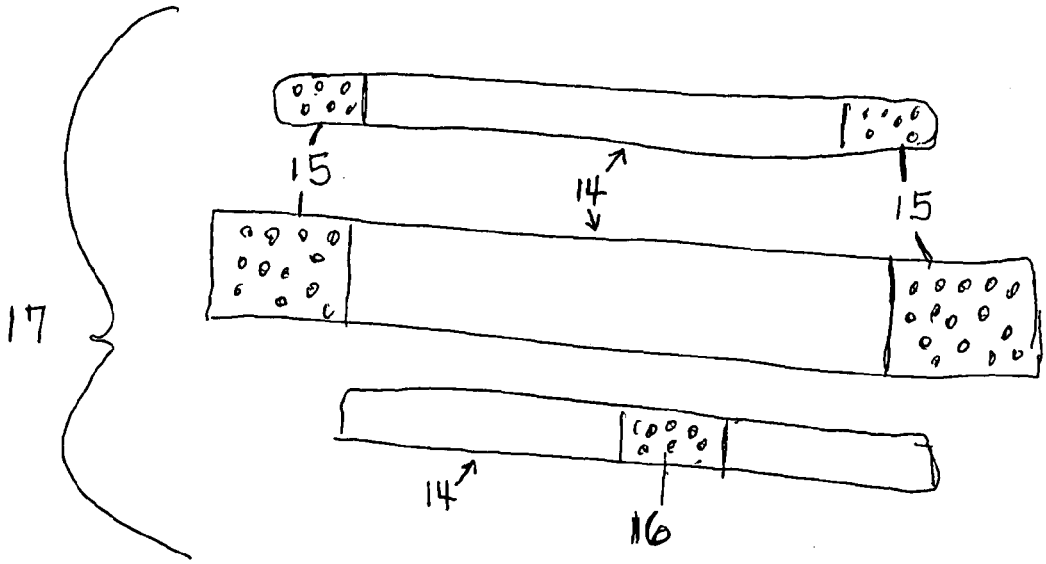
FIG. 6: is view of the multiple straps
Figure 7:
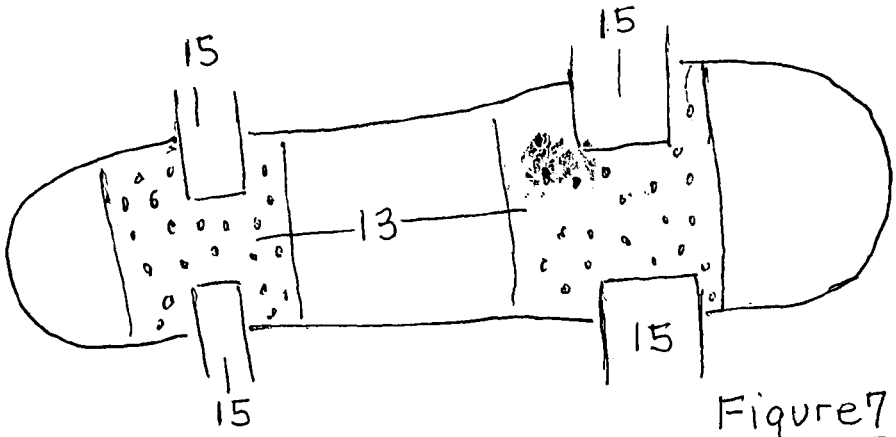
FIG. 7: is a bottom view of another platform
Figure 8:
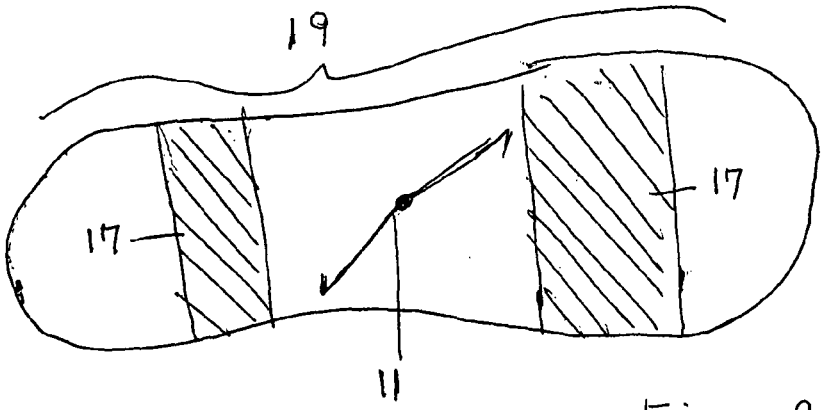
FIG. 8: is a bottom view of another platform
Figure 9:
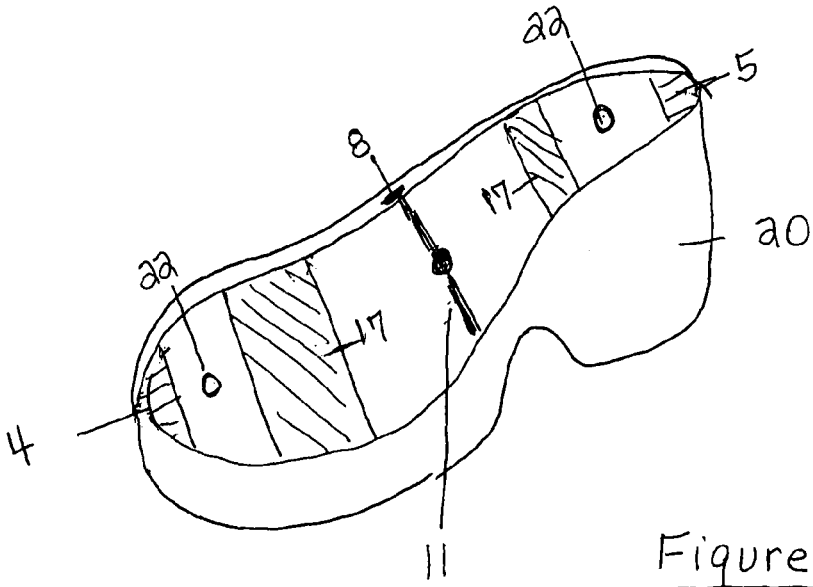
FIG. 9: is a perspective view of the platform and lower base combined
Figure 10:
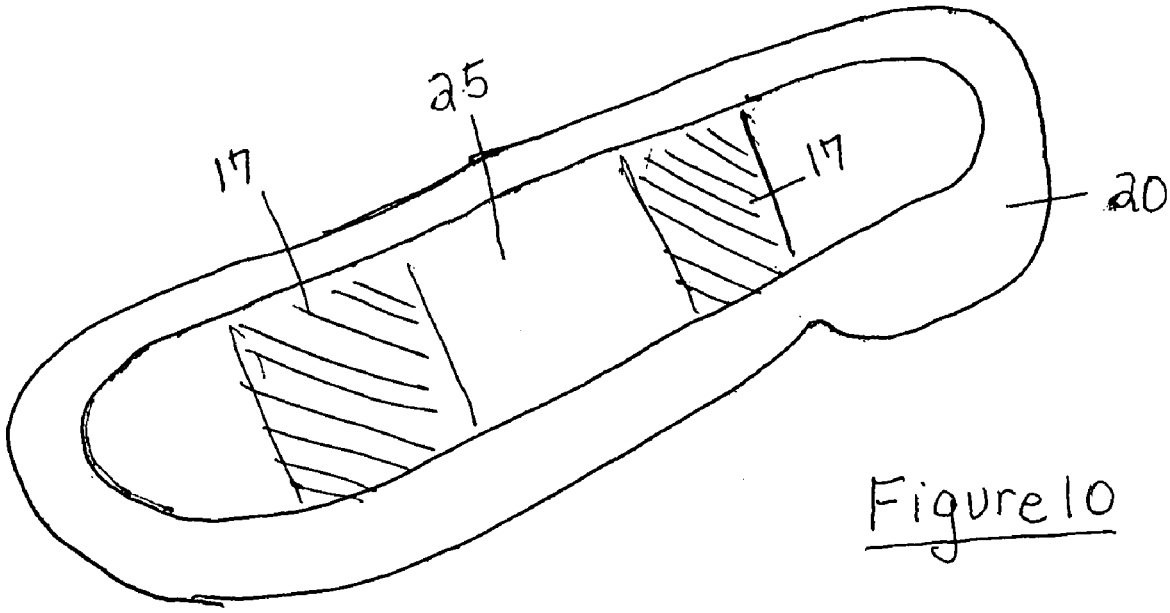
Figure 11:
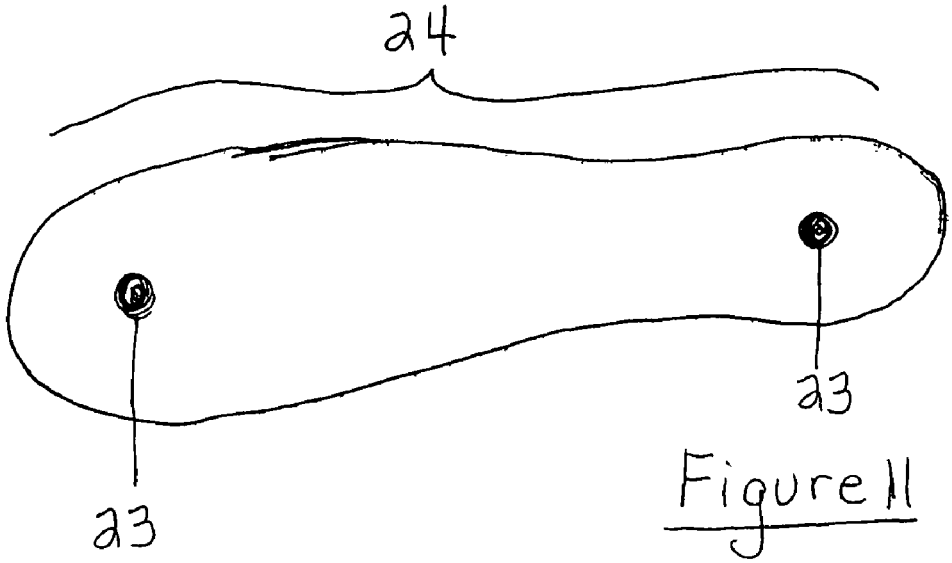
Figure 1A:
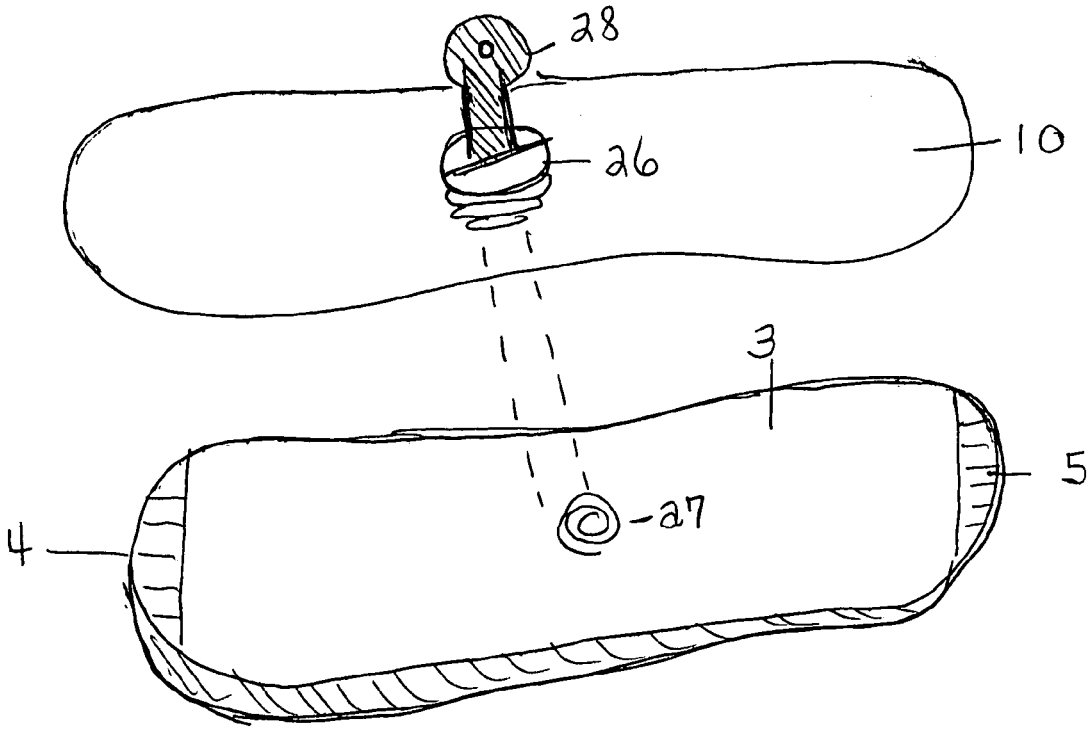
Figure 14:
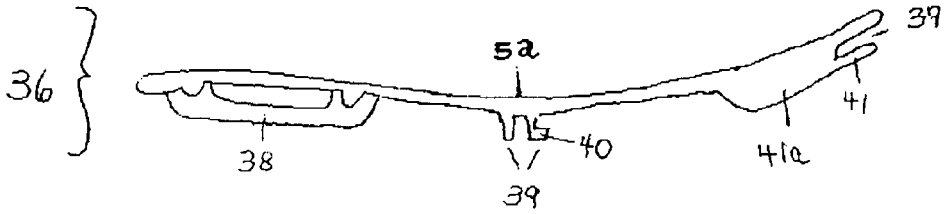
Figure 15:
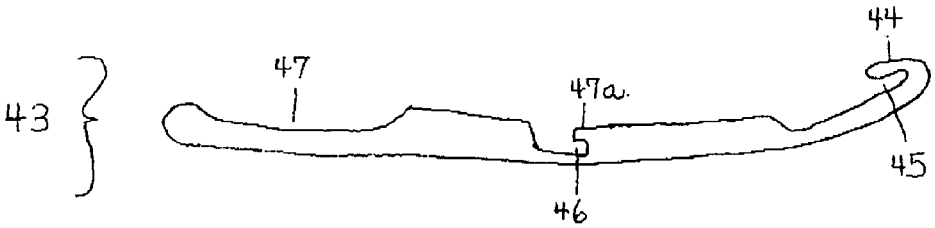
Figure 16:
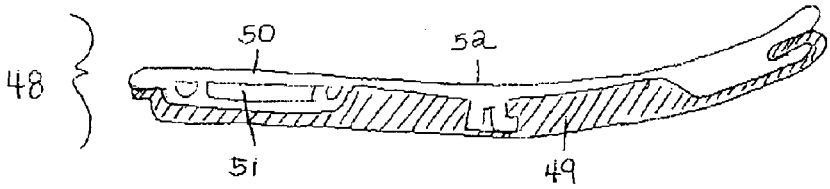
Figure 17:
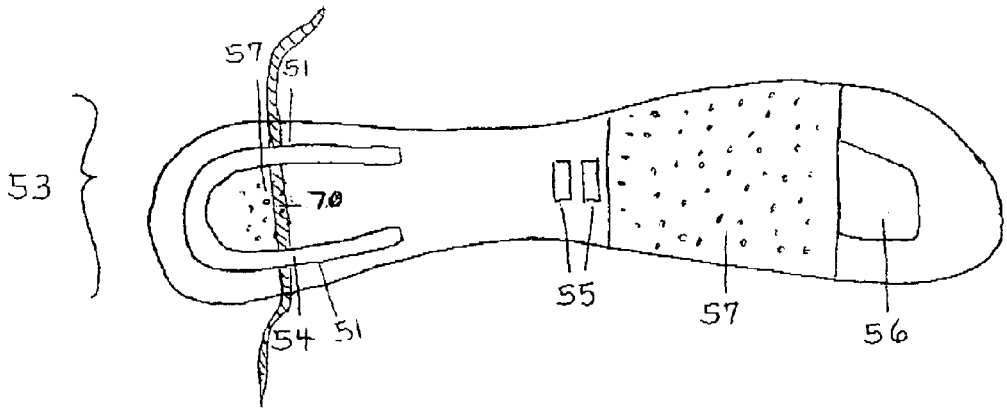
Figure 18:
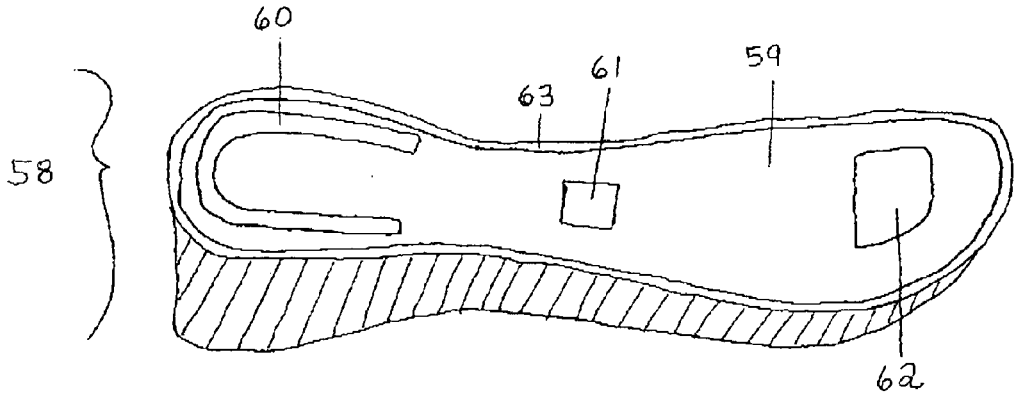
Figure 19:
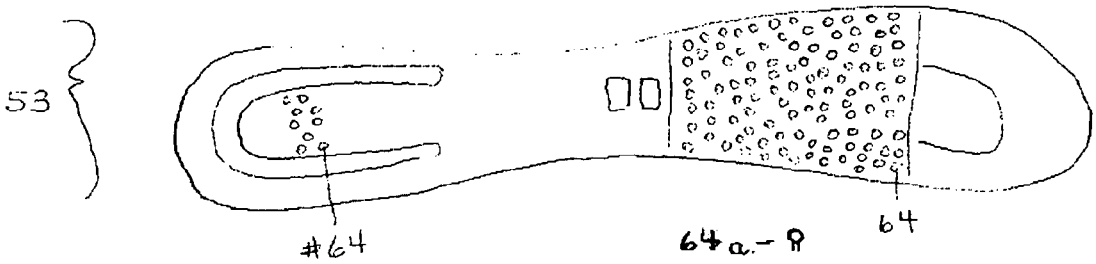
Figure 20:
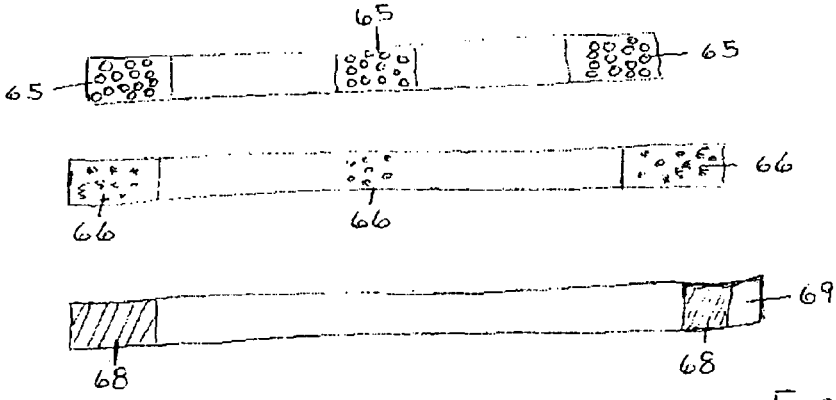
Figure 21:
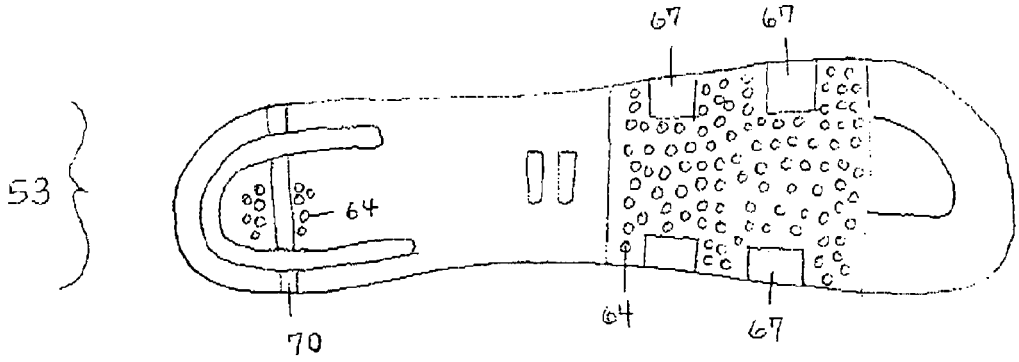

A hook and loop fastener is applied to the underside of the platform. (FIG. 5 #13) and also to various areas on the underside of the straps (FIGS. 6 # 15 & 16) The straps are attached to the underside of one side of the platform (FIG. 7 #15) and the other side of the strap overlaps the platform and is secured on the corresponding other side of the platform also to the hook and loop fastener on the underside of the platform. (FIG. 7 # 15) The finished side of the straps overlaps the platform (FIG. 10 #17) The straps can be removed from the platform and replaced by another chosen strap style when desired, or adjusted for comfort by moving the straps to other areas of the hook and loop fastener on the platform. When the straps are applied to the removable/replaceable platform and inserted and locked into the base (FIG. 9) the final (top layer) insole which has hook and loop fastener attached to its front and rear underside (FIG. 11 # 23) can be inserted under the straps and placed into the remaining hollow area of the base (on top of the platform) which has corresponding hook and loop fastener on its superior side (front and back) to secure (FIG. 9 # 22). The (top layer) insole hides the shoes components (FIG. 10) and creates a comfortable contact support for the foot. The straps and insole cooperate to form a shoe upper for receiving the foot. Alternate hardware for securing the insole may be used. All platforms, straps, straps on platforms and insoles are interchangeable and mix and match to all shoe base styles (high heel, flat or wedge styles).

Another variation of the platform (FIG. 13) would divide the platform into two pieces. (FIGS. 13 # 29 & 30) which will overlap each other and lock into reciprocal grooves. The grooves (on the front underside of the platform (FIG. 13 # 33)) and on the rear superior side of the platform (FIG. 13 # 31) will meet and lock at desired places and depending on that location will enlarge or minimize the platform to accomplish filling the hollow area of the base. This design will accomplish having a platform (purchased with or without straps) which is adjustable to fit numerous size bases. The front of the platform (Figure # 29) will easily slide under the front ledge Figure #4) and the back side of the platform (Figure # 30) will easily slide under the back ledge Figure (Figure #5) and the two will overlap and meet at the correct groove for the base size in the area of the middle part of the base. The screw in the middle (FIGS. 12 #26 & 35) will not only secure the platform to the base, but will maintain the tension required to keep both sides of the platform under their corresponding front and rear ledge. Various holes in the rear platform (Figure # 31) and one in the front platform (Figure # 26) will allow the screw to pass through (Figure # 35) the platform and enter the shoe base hole with tread to secure at the approx. location of the middle of the base.

KEY TO DIAGRAMS

FIG. 1

1. Hollowed out area of shoe base approx ⅜" high and creates a perimeter of approx ¼" wall which surrounds the superior perimeter of the base.

2. Perimeter wall of shoe base.

3. Superior view of shoe base

4. Front ledge-diagonal across toe area approx ½" wide

5. Rear ledge-diagonal across heel area approx ½" wide

FIG. 2

6. Right side of wall base approx ⅜" high

7. Groove on mid wall center—left side

FIG. 3

8. Groove on mid wall center right side

9. Left side of wall base approx ⅜" high

FIG. 4

10. Platform

11. Lock on mid superior platform

FIG. 5

12. Underside of platform

13. Velcro glued onto underside of platform

FIG. 6

14. Underside of shoe strap

15. Velcro sewn or glued on underside ends of strap.

16. Velcro on middle underside of strap

17. Straps

FIG. 7

18. Velcro tips of straps in contact with corresponding Velcro on underside of shoe platform.

FIG. 8

19. Appearance of superior platform with straps and platform locked into place.

20. Shoe base

21. Appearance of superior shoe with insole

22. Platform with Velcro on top

FIG. 9

23. Corresponding Velcro on underside of insole which adheres to Velcro on superior side of platform

FIG. 10

25. Superior side of insole

FIG. 11

24. Underside of insole.

FIG. 12

26. Flat head screw

27. Hole with internal thread

28. Key to turn flat head screw

FIG. 13

29. Front half of platform

30. Back end of platform

31. Grooves on superior side of back (heel) half of platform

32. Holes for screw entry on back (heel) half of platform

33. Grooves on underside of front half of platform

34. Front and rear platform in base

35. Screw connected to base through holes of both halves of platform (connected in the center of the base)

The invention claimed is:

1. A Sandal comprised of removable footwear components comprising:

a lower base having a hollowed out central area with a perimeter sidewall, the sidewall having a forward and rearward ledges and a center hole formed at a midpoint area of the base, a removable middle platform sized to fit snugly within the perimeter sidewalls of the base, the platform having an undersurface having hook and loop fastening material and a center hole at a midpoint area of the platform, a plurality of straps having hook and loop material, wherein an end of the straps are folded under the platform to secure the hook and loop components of the strap and platform together, and a platform lock, wherein the removable middle platform is inserted to the lower base under the front and rear ledges and is further secured by the platform lock which enters the central holes of the platform and the lower base to lock the base, the platform and the straps together, wherein the base, the platform and the straps are all readily interchangeable with other footwear components to form multiple shoe base styles.

* * * * *